US008015783B2

(12) United States Patent
Iwasa et al.

(10) Patent No.: US 8,015,783 B2
(45) Date of Patent: Sep. 13, 2011

(54) FORM-FILL-SEAL MACHINE

(75) Inventors: Takuya Iwasa, Shiga (JP); Makoto Ichikawa, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 277 days.

(21) Appl. No.: 12/444,327

(22) PCT Filed: Oct. 29, 2007

(86) PCT No.: PCT/JP2007/071044
§ 371 (c)(1),
(2), (4) Date: Apr. 3, 2009

(87) PCT Pub. No.: WO2008/053847
PCT Pub. Date: May 8, 2008

(65) Prior Publication Data

US 2010/0101193 A1 Apr. 29, 2010

(30) Foreign Application Priority Data

Oct. 30, 2006 (JP) ..... 2006-294821

(51) Int. Cl.
*B65B 9/20* (2006.01)
*B65B 59/00* (2006.01)

(52) U.S. Cl. ..... 53/551; 53/201

(58) Field of Classification Search ..... 53/551, 53/552, 201
See application file for complete search history.

(56) References Cited

U.S. PATENT DOCUMENTS

| | | | | | |
|---|---|---|---|---|---|
| 4,423,585 | A | * | 1/1984 | Monsees et al. | 53/551 |
| 4,430,844 | A | * | 2/1984 | James | 53/550 |
| 4,660,356 | A | * | 4/1987 | Simionato | 53/551 |
| 4,800,707 | A | * | 1/1989 | Rabus | 53/552 |
| 5,125,217 | A | | 6/1992 | Fukuda | |
| 5,463,850 | A | * | 11/1995 | Fukuda | 53/551 |
| 5,473,866 | A | * | 12/1995 | Maglecic et al. | 53/552 |
| 5,537,798 | A | * | 7/1996 | Fukuda et al. | 53/201 |
| 5,715,656 | A | * | 2/1998 | Pearce | 53/201 |
| 5,971,905 | A | * | 10/1999 | Fukuda | 53/551 |
| 7,121,067 | B1 | * | 10/2006 | Fukuda et al. | 53/551 |
| 2003/0217531 | A1 | * | 11/2003 | Keen et al. | 53/552 |

FOREIGN PATENT DOCUMENTS

| | | | |
|---|---|---|---|
| JP | S56-012006 | U | 7/1979 |
| JP | H05-124606 | A | 5/1993 |
| JP | 2004-210297 | A | 7/2004 |
| JP | 2004-352306 | A | 12/2004 |
| WO | WO-2007/142114 | A1 | 12/2007 |

* cited by examiner

*Primary Examiner* — Stephen F Gerrity
(74) *Attorney, Agent, or Firm* — Global IP Counselors, LLP

(57) ABSTRACT

A form-fill-seal machine for manufacturing pouches of a plurality of types having different shapes includes a tubular part, a conveying part and a sealing part. The tubular part is replaceable according to a shape of the pouch to be manufactured. The conveying part is configured and arranged to convey tubular packaging material along the tubular part with an internal surface of the packaging material facing an external surface of the tubular part. A position of the conveying part with respect to the tubular part is selectively movable according to the shape of the pouch to be manufactured. The sealing part is configured and arranged to seal a prescribed position on the packaging material conveyed by the conveying part.

10 Claims, 13 Drawing Sheets

FORM-FILL-SEAL MACHINE

CROSS-REFERENCE TO RELATED APPLICATIONS

This national phase application claims priority to Japanese Patent Application No. 2006-294821 filed on Oct. 30, 2006. The entire disclosure of Japanese Patent Application No. 2006-294821 are hereby incorporated herein by reference.

TECHNICAL FIELD

The present invention relates to a form-fill-seal machine, and in particular relates to a form-fill-seal machine for manufacturing pouches of a plurality of types having different shapes.

BACKGROUND ART

Form-fill-seal machines conventionally load snack food or another article that is to be packaged into a pouch while the pouch is being manufactured.

An example of a form-fill-seal machine for manufacturing pouches known as "pillow types" (hereinafter, a "pillow-type form-fill-seal machine") is described in Japanese Laid-Open Patent Application No. 2004-210297. Specifically, in a pillow-type form-fill-seal machine, a sheet-form film is generally fed from a film roll and conveyed in a prescribed direction of conveyance by a conveying mechanism composed of a pull-down belt or the like. The sheet-form film fed from the roll of film is then formed into a tubular shape by a former and a tube, and the vertically extending overlapping edges of the tubular film are then heat sealed (heat welded) by a vertical sealing mechanism. Packaged material is filled from the tube to the inside of the tubular film, which will ultimately be made into pouches. The portions that will become the upper end parts of a pouch and the portions that will become the lower end parts of the subsequent pouch are heat-sealed simultaneously by a horizontal sealing mechanism below the tube. The center of the heat-sealed portion (the horizontally sealed portion) is then cut by a cutter.

An example of a form-fill-seal machine for manufacturing pouches known as "hem-seal types" (hereinafter, a "hem-seal-type form-fill-seal machine") is described in Japanese Laid-Open Patent Application No. 2004-352306. Like the pillow-type form-fill-seal machine, the hem-seal-type form-fill-seal machine requires a former, a tube, a conveying mechanism, a vertical sealing mechanism, a horizontal sealing mechanism, and other components.

DISCLOSURE OF THE INVENTION

It has been proposed to provide exchangeability to some components of the pillow-type form-fill-seal machine and the hem-seal-type form-fill-seal machine, thereby providing a form-fill-seal machine (hereinafter, a "flexible form-fill-seal machine") that is capable of manufacturing pouches of a plurality of types such as pillow-type pouches, hem-seal-type pouches, or other pouches in a single machine (e.g., International Application Publication No. WO 2007/142114 A1).

Unlike pillow-type form-fill-seal machines, in hem-seal-type form-fill-seal machines, a hem-forming mechanism must be attached for making creases extending vertically at the corners of the pouch and for forming hem parts. The attachment location of the conveying mechanism is therefore usually shifted downstream by the space occupied by the hem-forming mechanism in hem-seal-type form-fill-seal machines as compared to pillow-type form-fill-seal machines.

In a flexible form-fill-seal machine, the location at which the conveying mechanism must be positioned may change depending on the type of pouch to be manufactured. An operation for changing the conveying mechanism is therefore necessary when changing the type of pouch to be manufactured. With this changing operation, the operation for modifying the form-fill-seal machine often requires large amounts of time.

It is an object of the present invention to facilitate the modification operation for modifying a form-fill-seal machine from a state capable of manufacturing one type of pouch to a state capable of manufacturing another type of pouch.

A form-fill-seal machine according to a first aspect comprises a tubular part, a conveying part, and a sealing part, and adapted to manufacture pouches of a plurality of types having different shapes. The tubular part is replaceable according to a shape of the pouch to be manufactured. The conveying part is configured and arranged to convey tubular packaging material along the tubular part with an internal surface of the packaging material facing an external surface of the tubular part. A position of the conveying part with respect to the tubular part is selectively movable according to the shape of the pouch. The sealing part is configured and arranged to seal a prescribed position on the packaging material conveyed by the conveying part.

In this form-fill-seal machine, the position of the conveying part can be selected according to the shape of the pouches to be manufactured. Merely changing the position of the conveying part is thereby sufficient for the conveying part, when changing the tubular part and other components necessary for manufacturing a different type of pouch in this form-fill-seal machine. The modification operation for modifying this form-fill-seal machine from a state capable of manufacturing one type of pouch to a state capable of manufacturing another type of pouch can therefore be readily performed.

A form-fill-seal machine according to a second aspect is the form-fill-seal machine according to the first aspect, wherein the position of the conveying part with respect to the tubular part is selectively movable between a first position and a second position. The second position is further downstream than the first position in a direction of conveyance of the packaging material.

The conveying part can be moved in the direction of conveyance of the packaging material in this form-fill-seal machine.

A form-fill-seal machine according to a third aspect is the form-fill-seal machine according to the second aspect, wherein the conveying part is configured and arranged to slide between the first position and the second position to change the position of the conveying part with respect to the tubular part.

The position of the conveying part can be changed by sliding the conveying part in this form-fill-seal machine. Changing this form-fill-seal machine from a state capable of manufacturing one type of pouch to a state capable of manufacturing another type of pouch is therefore more readily performed.

A form-fill-seal machine according to a fourth aspect is the form-fill-seal machine according to the second aspect, wherein the conveying part is configured and arranged to swivel between the first position and the second position to change the position of the conveying part with respect to the tubular part.

The position of the conveying part can be changed by swiveling the conveying part in this form-fill-seal machine. Changing this form-fill-seal machine from a state capable of manufacturing one type of pouch to a state capable of manufacturing another type of pouch is therefore more readily performed.

A form-fill-seal machine according to a fifth aspect is the form-fill-seal machine according to the second aspect, wherein the conveying part has a drive shaft and a belt member. The drive shaft is rotatably driven. The belt member is wound around the drive shaft to form a conveying surface for contacting the packaging material.

The belt member wound around the drive shaft in this form-fill-seal machine revolves around the drive shaft according to the rotation of the drive shaft. The packaging material contacts the belt member, whereby the packaging material is pulled along by the belt member and is conveyed in a prescribed direction of conveyance. The conveying part in this form-fill-seal machine can therefore convey the packaging material, which will be made into pouches, in the prescribed direction of conveyance.

A form-fill-seal machine according to a sixth aspect is the form-fill-seal machine according to the fifth aspect, further comprising a driving part. The driving part is configured and arranged to rotatably drive the drive shaft. The conveying part is configured and arranged to swivel about the drive shaft between the first position and the second position.

Changing the position of the conveying part in this form-fill-seal machine is implemented by swiveling the conveying part about the drive shaft. In other words, the drive shaft of the conveying part in this form-fill-seal machine need not be moved in the direction of conveyance of the packaging material when the conveying part is moved in the direction of conveyance of the packaging material in accordance with the shape of the pouches to be manufactured. The position of the conveying part can therefore be changed without moving the motor or other driving part, which is connected to the drive shaft, in the direction of conveyance of the packaging material. Changing this form-fill-seal machine from a state capable of manufacturing one type of pouch to a state capable of manufacturing another type of pouch is therefore more readily performed.

A form-fill-seal machine according to a seventh aspect is the form-fill-seal machine according to the second aspect, wherein the conveying part has a first conveying unit and a second conveying unit. The second conveying unit is positioned symmetrically with respect to the first conveying unit about the tubular part that extends in the direction of conveyance. The first conveying unit has a first drive shaft and a first belt member. The first drive shaft is rotatably driven. The first belt member is wound around the first drive shaft to form a first conveying surface for contacting the packaging material. The second conveying unit has a second drive shaft and a second belt member. The second drive shaft is rotatably driven. The second belt member is wound around the second drive shaft to form a second conveying surface for contacting the packaging material.

The two conveying units in this form-fill-seal machine are positioned with lateral symmetry relative to the tubular part that extends in the direction of conveyance. In other words, a substantially equal conveying force can be applied to both sides of the packaging material relative to the direction of conveyance. The packaging material in this form-fill-seal machine can thereby be conveyed while properly maintaining the shape of the material.

A form-fill-seal machine according to an eighth aspect is the form-fill-seal machine according to the seventh aspect, further comprising a driving part and a drive-force transmitting part. The driving part is configured and arranged to rotationally drive the first drive shaft. The drive-force transmitting part is configured and arranged to transmit to the second drive shaft a drive force transmitted to the first drive shaft from the driving part. The first conveying unit is configured and arranged to swivel about the first drive shaft between the first position and the second position. The second conveying unit is configured and arranged to swivel about the second drive shaft between the first position and the second position.

The two conveying units are positioned on the left and right sides of the tubular part in this form-fill-seal machine and share a single driving part. The drive force provided to the drive shaft of one of the conveying units is transmitted to the drive shaft of the other conveying unit via a timing belt or other drive-force transmitting part. In other words, a timing belt or other drive-force transmitting part is connected to the drive shafts of both of the conveying units of this form-fill-seal machine in addition to the motor or other driving part, and a complex driving mechanism is formed around both of the drive shafts.

The positions of both of the conveying units are changed by swiveling about the respective drive shafts. In other words, the drive shafts of the conveying units in this form-fill-seal machine need not be moved in the direction of conveyance of the packaging material when the conveying units are moved in the direction of conveyance of the packaging material according to the shape of the pouches to be manufactured. The position of the conveying units can therefore be changed without moving the complex driving mechanism, which is connected to both of the drive shafts, in the direction of conveyance of the packaging material.

This form-fill-seal machine can thereby be readily changed from a state capable of manufacturing one type of pouch to a state capable of manufacturing another type of pouch despite the fact that a complex driving mechanism is provided to the conveying part. The driving part is also shared between the conveying units in this form-fill-seal machine, and therefore the conveying units can be readily synchronized.

A form-fill-seal machine according to a ninth aspect is the form-fill-seal machine according to any of the second through eighth aspects, further comprising a shaking part when the conveying part is in the first position. The shaking part is positioned downstream of the conveying part in the direction of conveyance, and configured and arranged to sandwich and shake the packaging material.

When the conveying part is positioned in the upstream first position in this form-fill-seal machine, a shaking part can be positioned in the space opened at the downstream second position. This shaking part has a function of sandwiching and shaking the tubular packaging material, and serves to collect the products, which are to be filled into the pouches, at the bottom part of the pouches that are formed by horizontally sealing the tubular packaging material. The shaking part must generally be positioned downstream of the conveying part when manufacturing pillow-type pouches. This form-fill-seal machine can therefore ensure the proper positioning of the shaking part that is necessary when manufacturing pillow-type pouches.

A form-fill-seal machine according to a tenth aspect is the form-fill-seal machine according to any of the second through eighth aspects, further comprising a hem-forming part when the conveying part is in the second position. The hem-forming part is positioned upstream of the conveying part in the direction of conveyance, and configured and arranged to form a hem part in the packaging material.

When the conveying part is positioned in the downstream second position in this form-fill-seal machine, a hem-forming part can be positioned in the space opened at the upstream first position. This hem-forming part serves to form hem parts in the tubular packaging material and must generally be positioned upstream of the conveying part when manufacturing hem-seal-type pouches. This form-fill-seal machine can therefore ensure the proper positioning of the hem-forming part that is necessary when manufacturing hem-seal-type pouches.

In the form-fill-seal machine according to the first aspect, the position of the conveying part can be selected according to the shape of the pouches to be manufactured. Merely changing the position of the conveying part is thereby sufficient for that part when changing the tubular part and other components necessary for manufacturing a different type of pouch in this form-fill-seal machine. The modification operation for modifying this form-fill-seal machine from a state capable of manufacturing one type of pouch to a state capable of manufacturing another type of pouch is therefore readily performed.

BEST MODE FOR CARRYING OUT THE INVENTION

Overall Configuration

Figure 1:
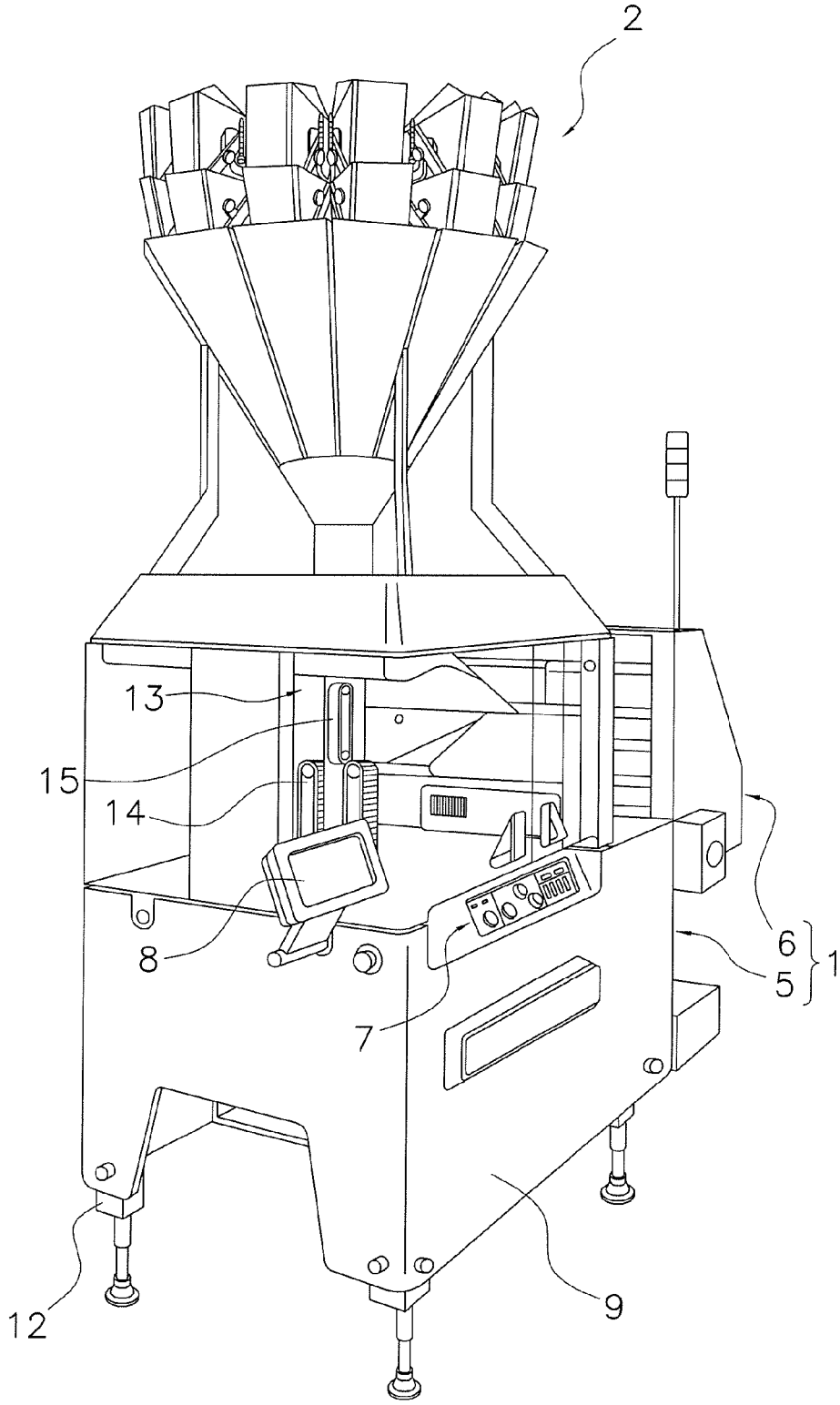
FIG. 1 is an overall perspective view of a form-fill-seal machine according to an embodiment of the present invention.
Figure 2:
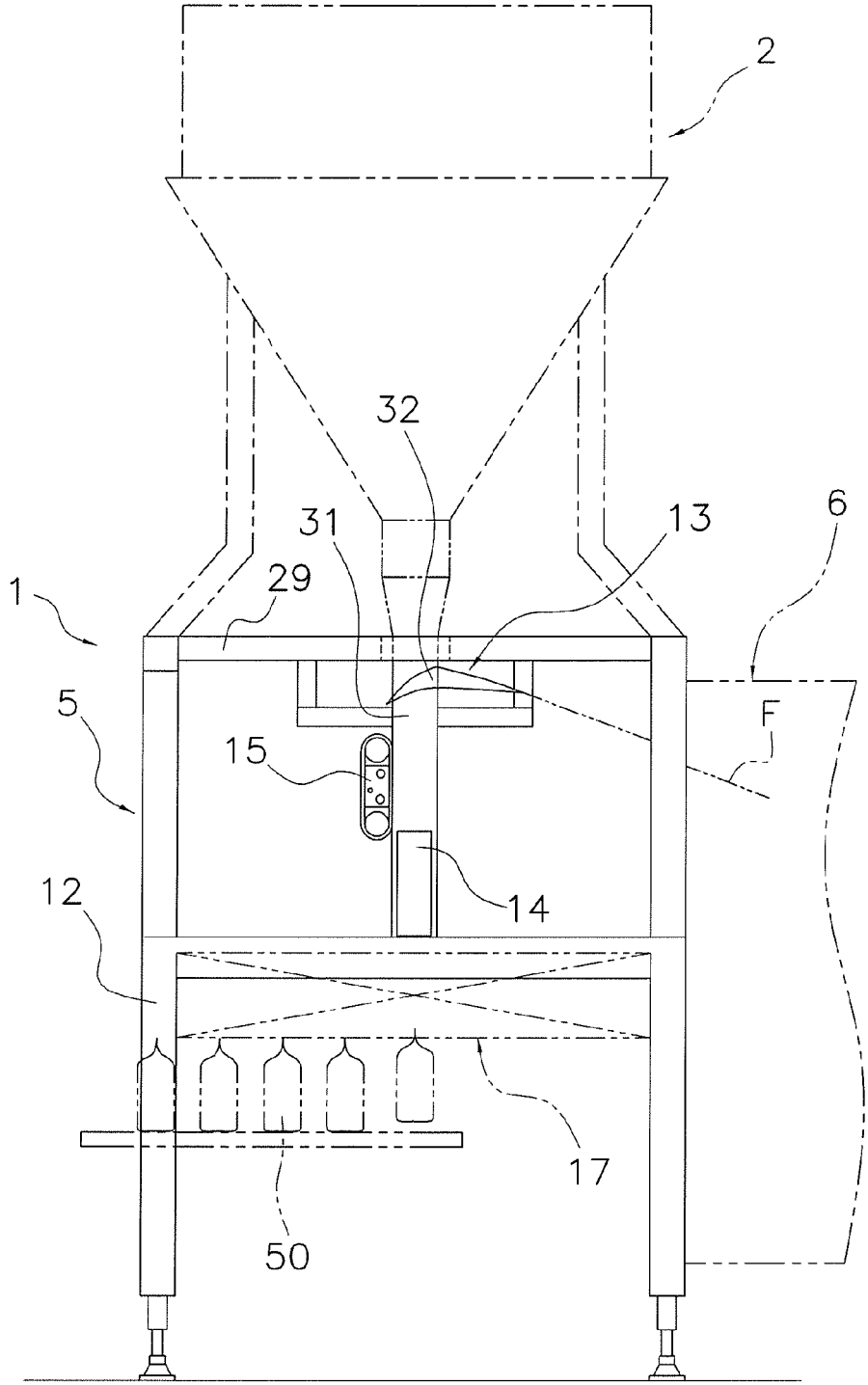
FIG. 2 is a schematic lateral view of the form-fill-seal machine according to the embodiment of the present invention.

A form-fill-seal machine 1 according to an embodiment of the present invention is shown in FIGS. 1 and 2. The form-fill-seal machine 1 shown in FIGS. 1 and 2 is a machine for packing potato chips or other products into pouches. The machine primarily includes a form-fill-seal unit 5, which packs the products into pouches, and a film-feeding unit 6 for feeding a film F, which is used to form the pouches, to the form-fill-seal unit 5. Operational switches 7 are positioned on the front surface of the form-fill-seal unit 5. A liquid crystal display 8 for displaying the operational state is positioned in a location visible to the operator who operates the operational switches 7.

Figure 5:
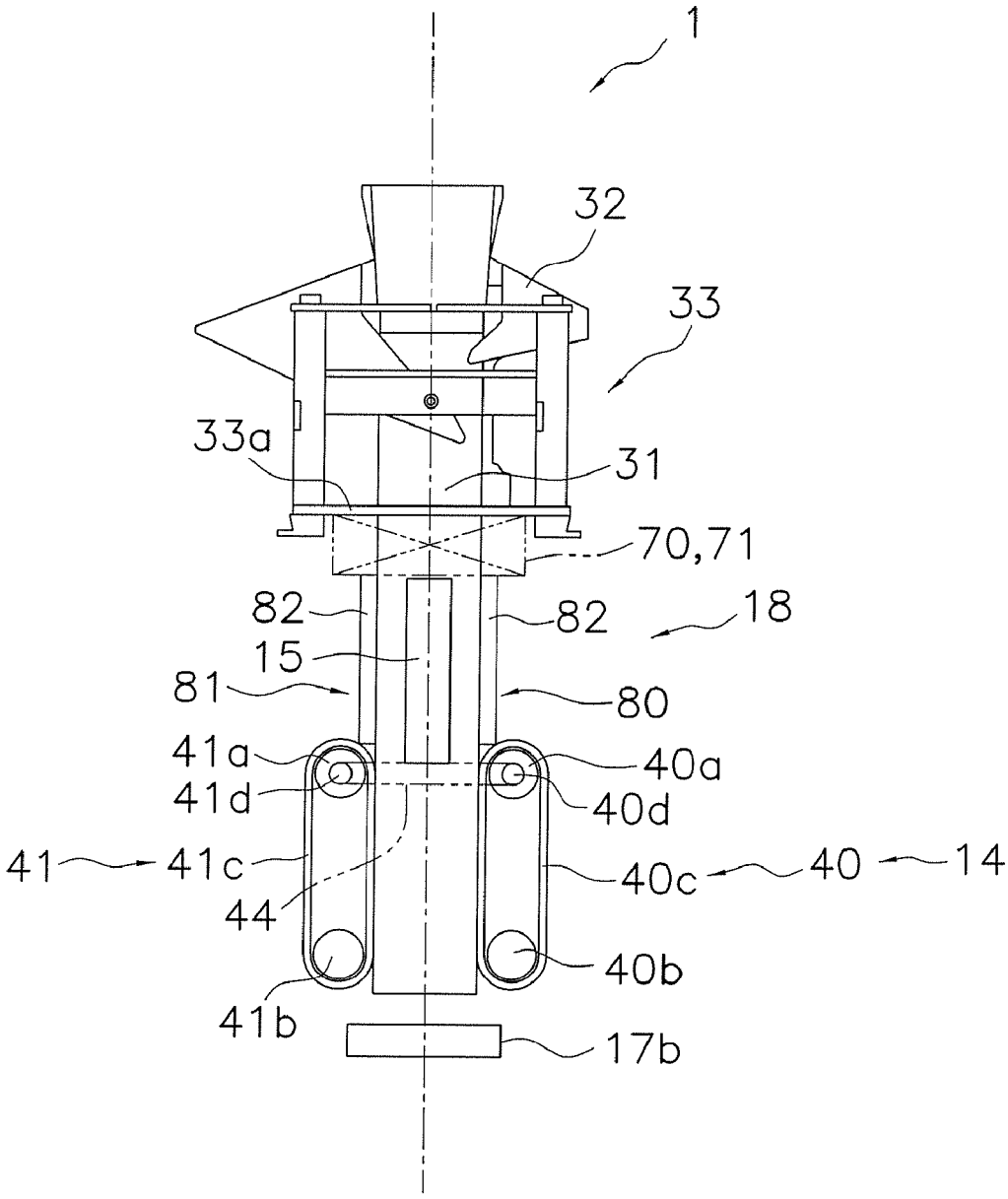
FIG. 5 is a front view that shows the main portions of the form-fill-seal machine in a state capable of manufacturing the hem-seal-type pouch.
Figure 6:
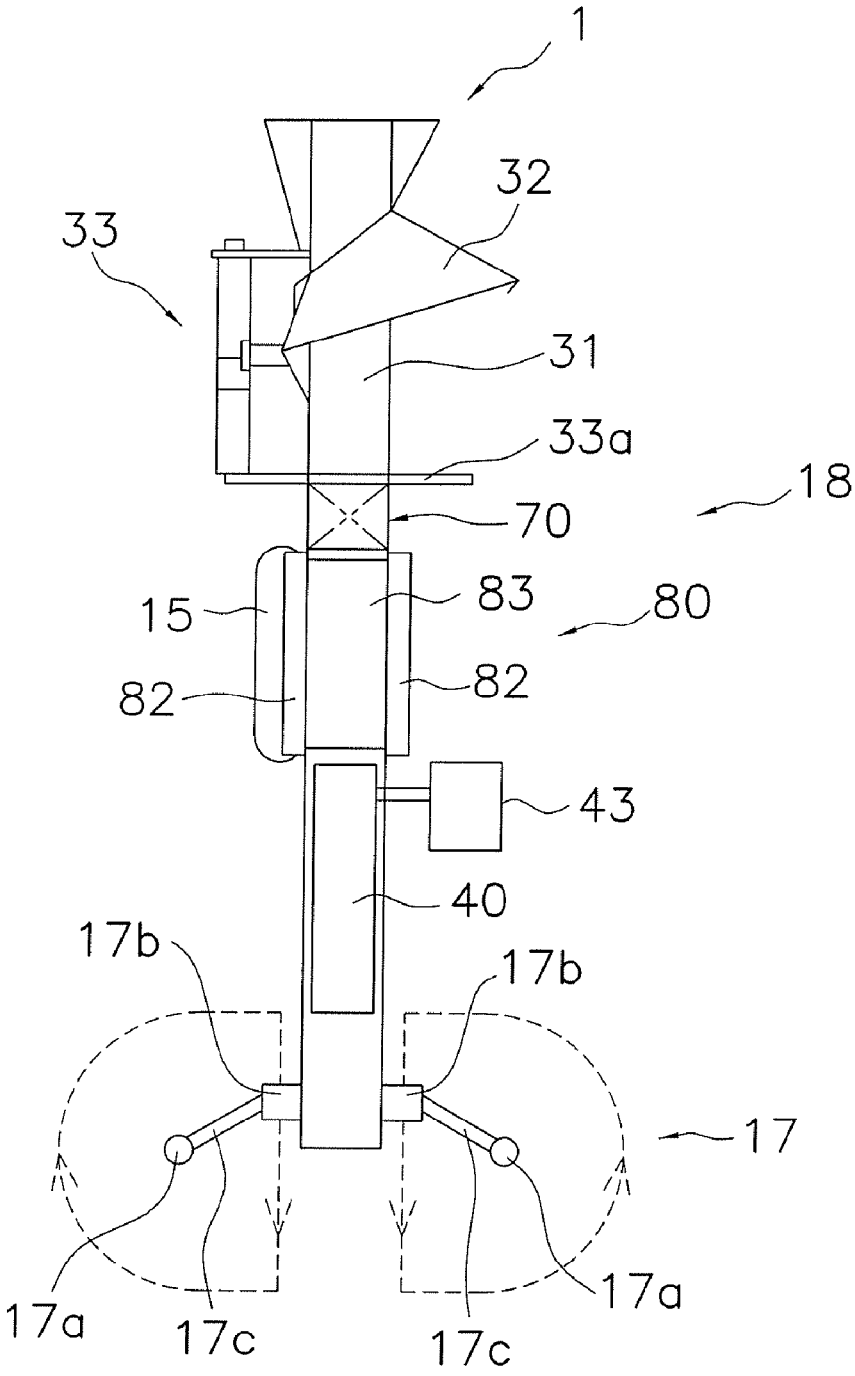
FIG. 6 is a lateral view that shows the main portions of the form-fill-seal machine in a state capable of manufacturing the hem-seal-type pouch.
Figure 7:
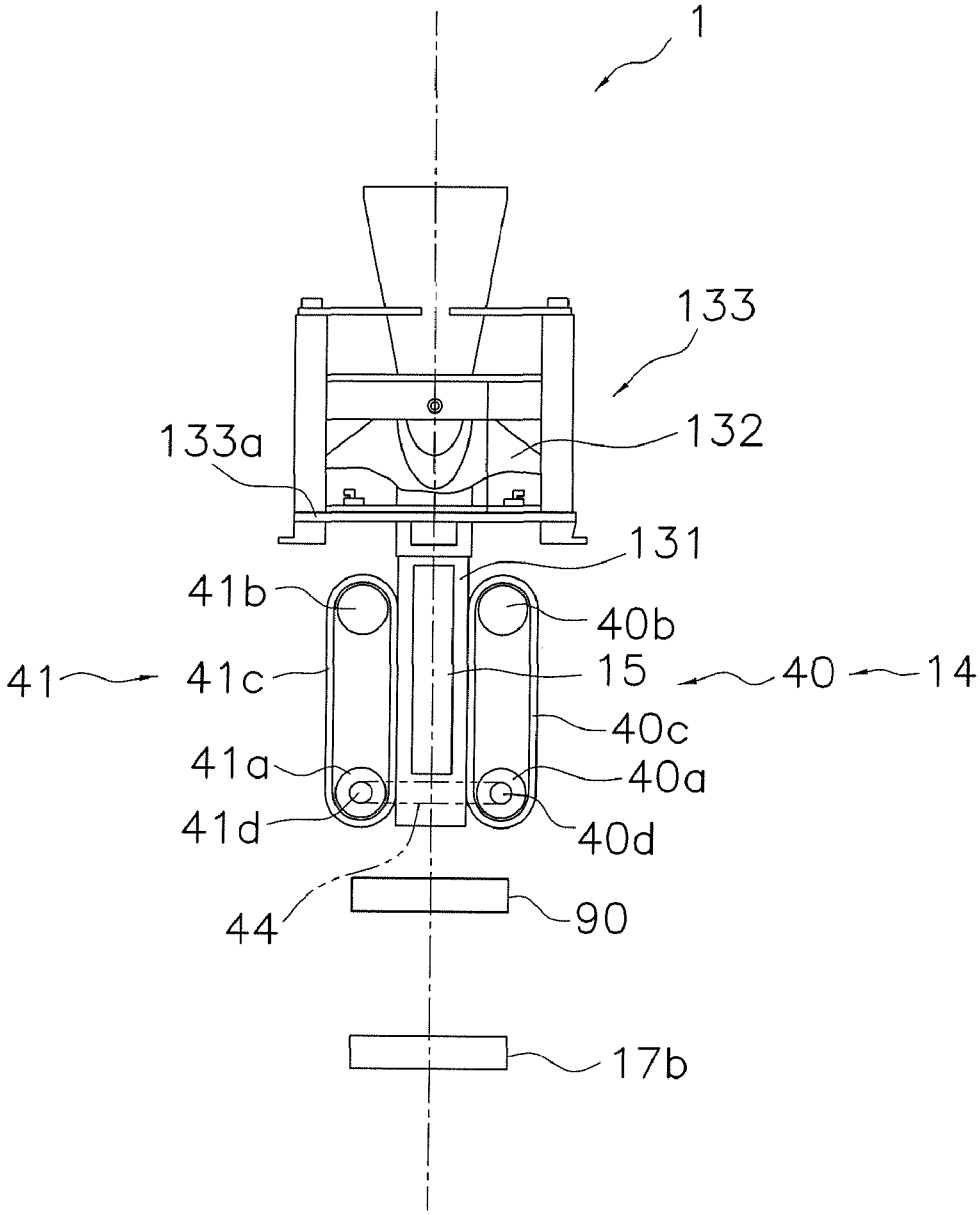
FIG. 7 is a front view that shows the main portions of the form-fill-seal machine in a state capable of manufacturing the pillow-type pouch.

This form-fill-seal machine 1 is a flexible form-fill-seal machine that is capable of manufacturing pouches of a plurality of types having different shapes in one machine by changing the appropriate components. This form-fill-seal machine 1 can manufacture, e.g., a so-called hem-seal-type pouch 50 (see FIG. 3) as well as a so-called pillow-type pouch 60 (see FIG. 4). FIGS. 5 and 6 show the main portions of the form-fill-seal machine 1 set so as to be capable of manufacturing the hem-seal-type pouch 50, and FIG. 7 shows the main portions of the form-fill-seal machine 1 set so as to be capable of manufacturing the pillow-type pouch 60. The form-fill-seal machine 1 can also be set so as to be capable of manufacturing pouches other than the hem-seal-type pouch 50 and the pillow-type pouch 60, but the manufacture of the hem-seal-type pouch 50 and the pillow-type pouch 60 will be used as an example below. FIGS. 1 and 2 show the form-fill-seal machine 1 in a state set so as to be capable of manufacturing the hem-seal-type pouch 50.

Figure 3:
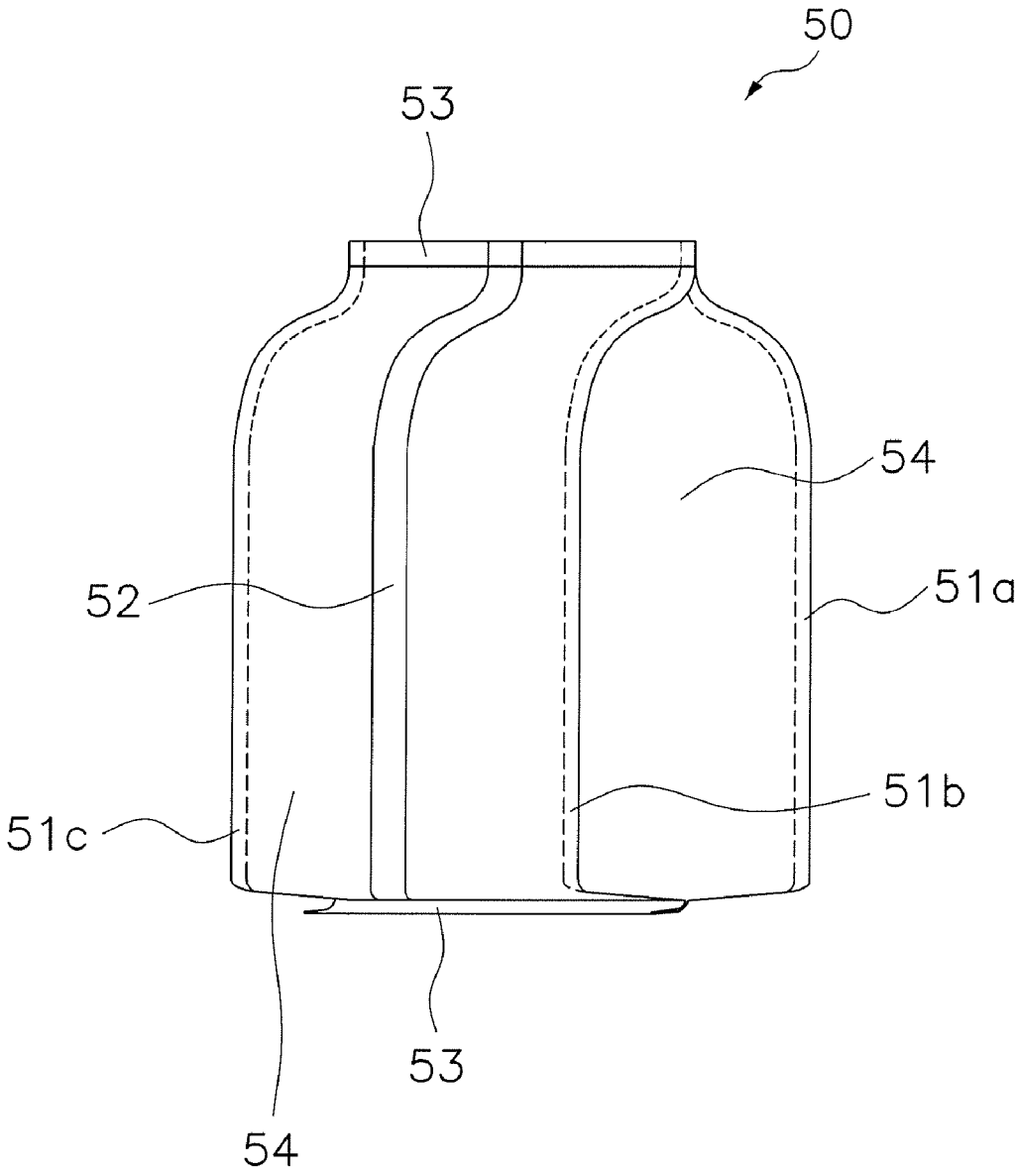
FIG. 3 shows a hem-seal-type pouch.

FIG. 3 shows the hem-seal-type pouch 50. The hem-seal-type pouch 50 is formed from the film F, which is shaped as a single rectangular sheet. The hem-seal-type pouch 50 has four lateral-surface parts 54, four hem parts 51*a* through 51*d*, a vertical seal part 52, and two horizontal seal parts 53. The pouch 50 is manufactured by forming the sheet-form film F into a polygonal tube shape to form the four lateral-surface parts 54, heat sealing in the vertical direction both overlapping edges of the film F formed into the polygonal tube shape to form the vertical seal part 52, heat sealing in the vertical direction the four corners of the polygonal tubular film F to form the four hem parts 51*a* through 51*d*, and heat sealing in the horizontal direction the portions of the polygonal tubular film F that will become the upper and lower ends of the pouch 50 to form the two horizontal seal parts 53. The vertical seal part 52 extends in the vertical direction near the center of one of the lateral-surface parts 54.

Figure 4:
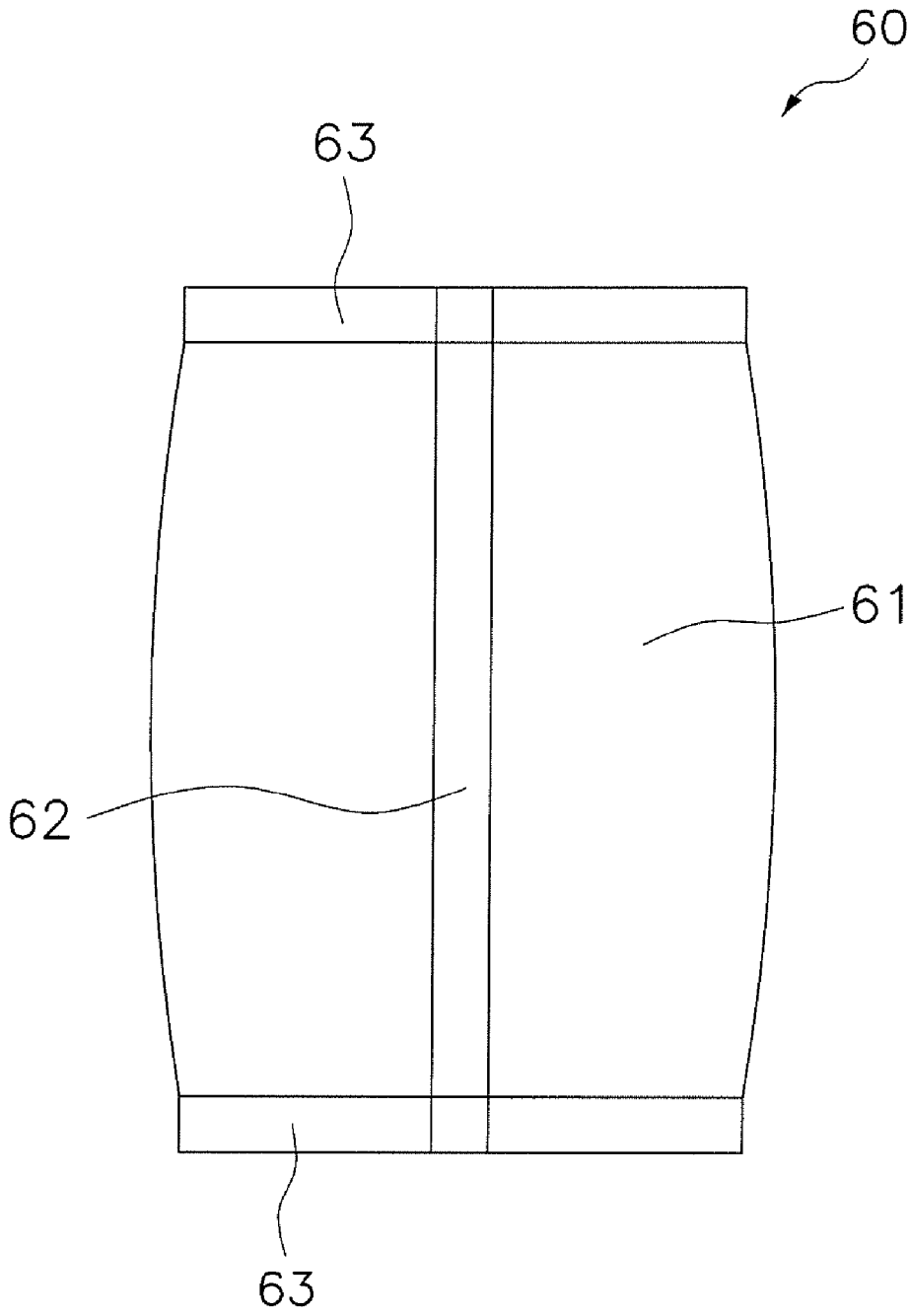
FIG. 4 shows a pillow-type pouch.

FIG. 4 shows the pillow-type pouch 60. The pillow-type pouch 60 is also formed from the film F, which is shaped as a single rectangular sheet. The pillow-type pouch 60 has a trunk part 61, a vertical seal part 62, and two horizontal seal parts 63. The pouch 60 is manufactured by forming the sheet-form film F into a circular tube shape, heat sealing in the vertical direction both overlapping edges of the film F formed into the circular tube shape to form the vertical seal part 62, and heat sealing in the horizontal direction the portions of the circular tube-shaped film F that will become the upper and lower ends of the pouch 60 to form the two horizontal seal parts 63.

Form-Fill-Seal Machine in Hem-Seal-Type Pouches Manufacturing State

The form-fill-seal machine 1 will first be described in a state set so as to be capable of manufacturing the hem-seal-type pouch 50.

(1) Film-Feeding Unit

The film-feeding unit 6 feeds the sheet-form film F to a forming mechanism 13 of the form-fill-seal unit 5, which will be described below. The film-feeding unit 6 is provided adjacent to the form-fill-seal unit 5. A film roll in which the film F is rolled is set in the film-feeding unit 6, and the film F is unwound from this film roll.

(2) Form-Fill-Seal Unit

The form-fill-seal unit 5 primarily includes the forming mechanism 13 for forming the sheet-form film F, which is sent from the film-feeding unit 6, into a polygonal tube shape; a conveying mechanism 14 for downwardly conveying the film F that has been formed into a polygonal tube shape by the forming mechanism 13 (referred to below as "polygonal tubular film Fc"); a hem-forming mechanism 18 for forming the hem parts 51*a* through 51*d* at the four corners of the polygonal tubular film Fc; a vertical sealing mechanism 15 for sealing the overlapping portions of the polygonal tubular film Fc in the vertical direction; a horizontal sealing mechanism 17 for sealing the portions of the polygonal tubular film Fc that will become the upper and lower ends of the pouch 50 in the horizontal direction and thereby sealing off the pouch 50; and a supporting frame 12 for supporting these mechanisms. A casing 9 is attached to the periphery of the supporting frame 12.

a) Forming Mechanism

The forming mechanism 13 has a tube 31 and a former 32.

The tube 31 is a vertically extending polygonal tubular member that has apertures at the top and bottom ends. The tube 31 is positioned so as to pass vertically through the aperture part that is provided near the center of a top plate 29 of the supporting frame 12. The tube 31 is fixed to the former 32 via a bracket that is not shown. Products that fall in prescribed amounts from a computer scale 2 are placed into the aperture part at the top end of the tube 31. The computer scale 2 is provided above the form-fill-seal unit 5 and is a combination weighing device that includes feeders, pool hoppers, weighing hoppers, a chute for collection and discharge, and the like.

The former 32 is positioned so as to enclose the tube 31 in the vicinity of the upper part of the tube 31. The former 32 is shaped so that the sheet-form film F fed from the film-feeding unit 6 is formed into a polygonal tube shape when passing between the former 32 and the tube 31. The former 32 is affixed to a base plate 33*a* of a supporting member 33 that is supported by the supporting frame 12.

b) Hem-Forming Mechanism

The hem-forming mechanism 18 has a pair of hem-forming units 70, 71 and a pair of hem-sealing units 80, 81, as shown in FIGS. 5 and 6. The hem-forming units 70, 71 are positioned with lateral symmetry relative to the tube 31 that extends in the vertical direction and are positioned below the joining portion of the tube 31 and the former 32. The hem-sealing units 80, 81 are positioned with lateral symmetry relative to the tube 31 that extends in the vertical direction. The hem-sealing units 80, 81 are positioned directly below the hem-forming units 70, 71, respectively, and directly above pull-down belts 40, 41, respectively, which will be described below. The hem-forming units 70, 71 both have the same configuration, and the hem-sealing units 80, 81 both have the same configuration. Therefore, only the hem-forming unit 70 and the hem-sealing unit 80 will be described below, and descriptions of the hem-forming unit 71 and the hem-sealing unit 81 will be omitted.

Figure 8:
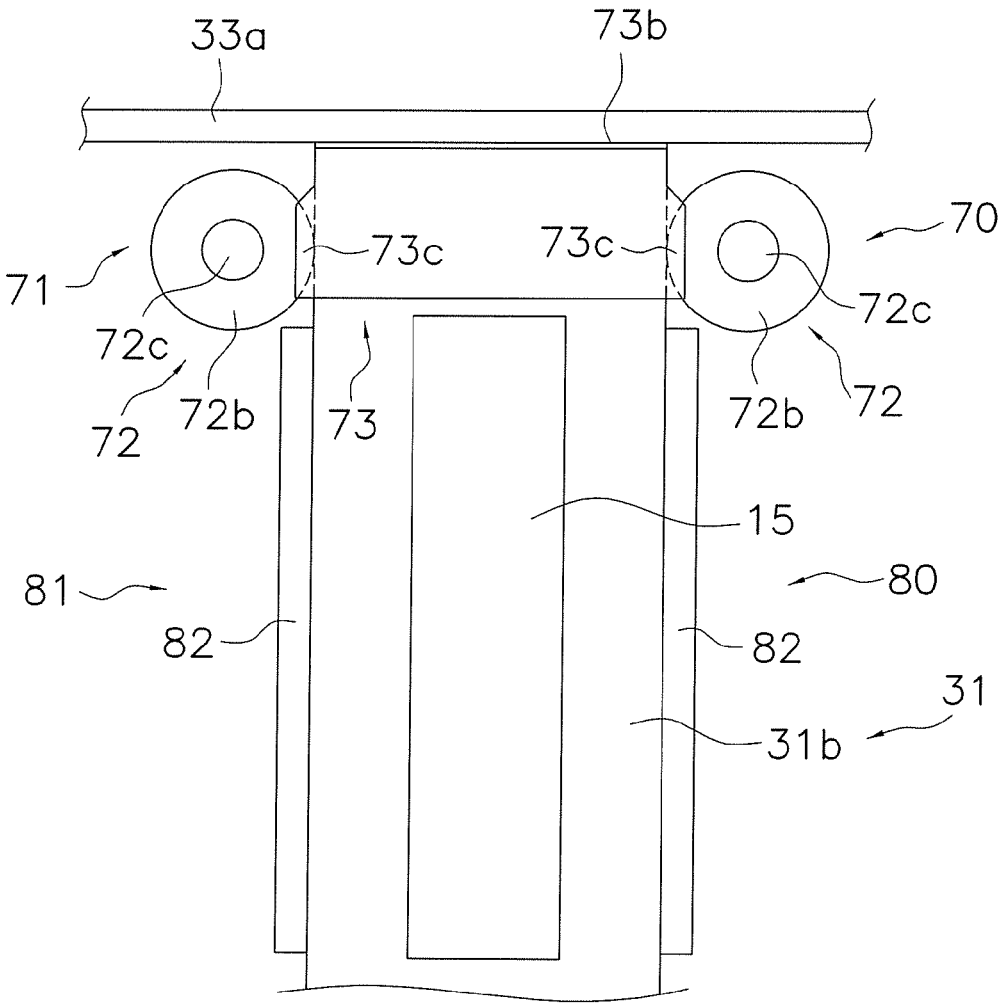
FIG. 8 is an enlarged front view of the area around the hem-forming unit of the form-fill-seal machine.
Figure 9:
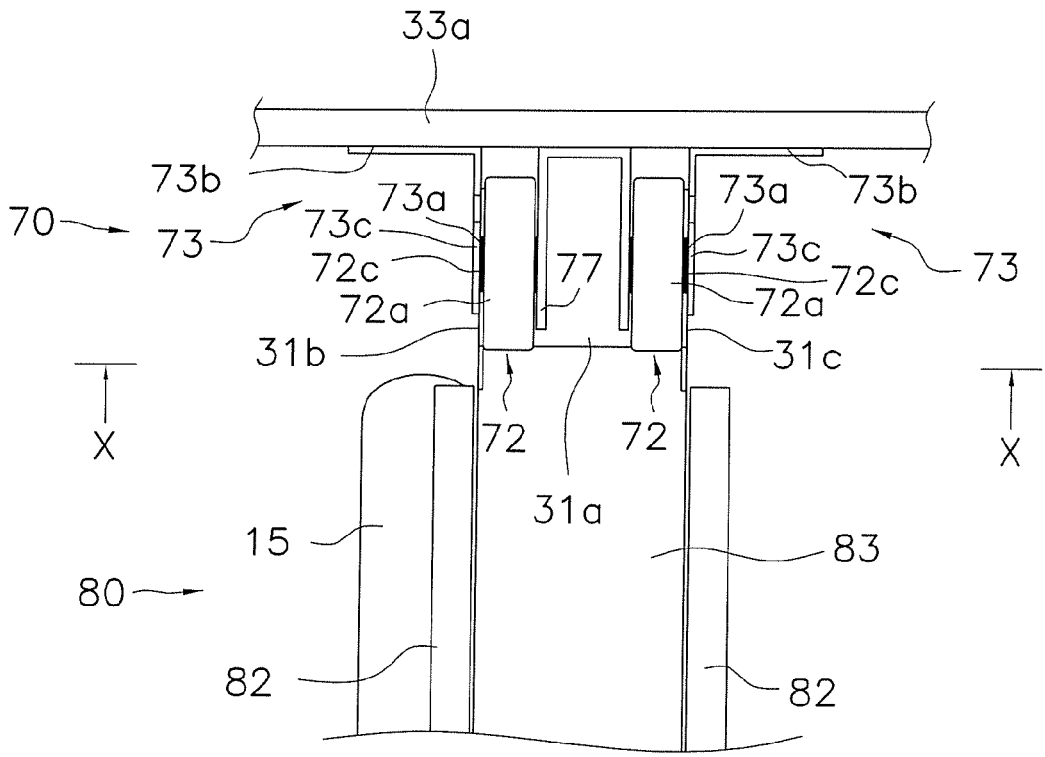
FIG. 9 is an enlarged lateral view of the area around the hem-forming unit of the foam-fill-seal machine.
Figure 10:
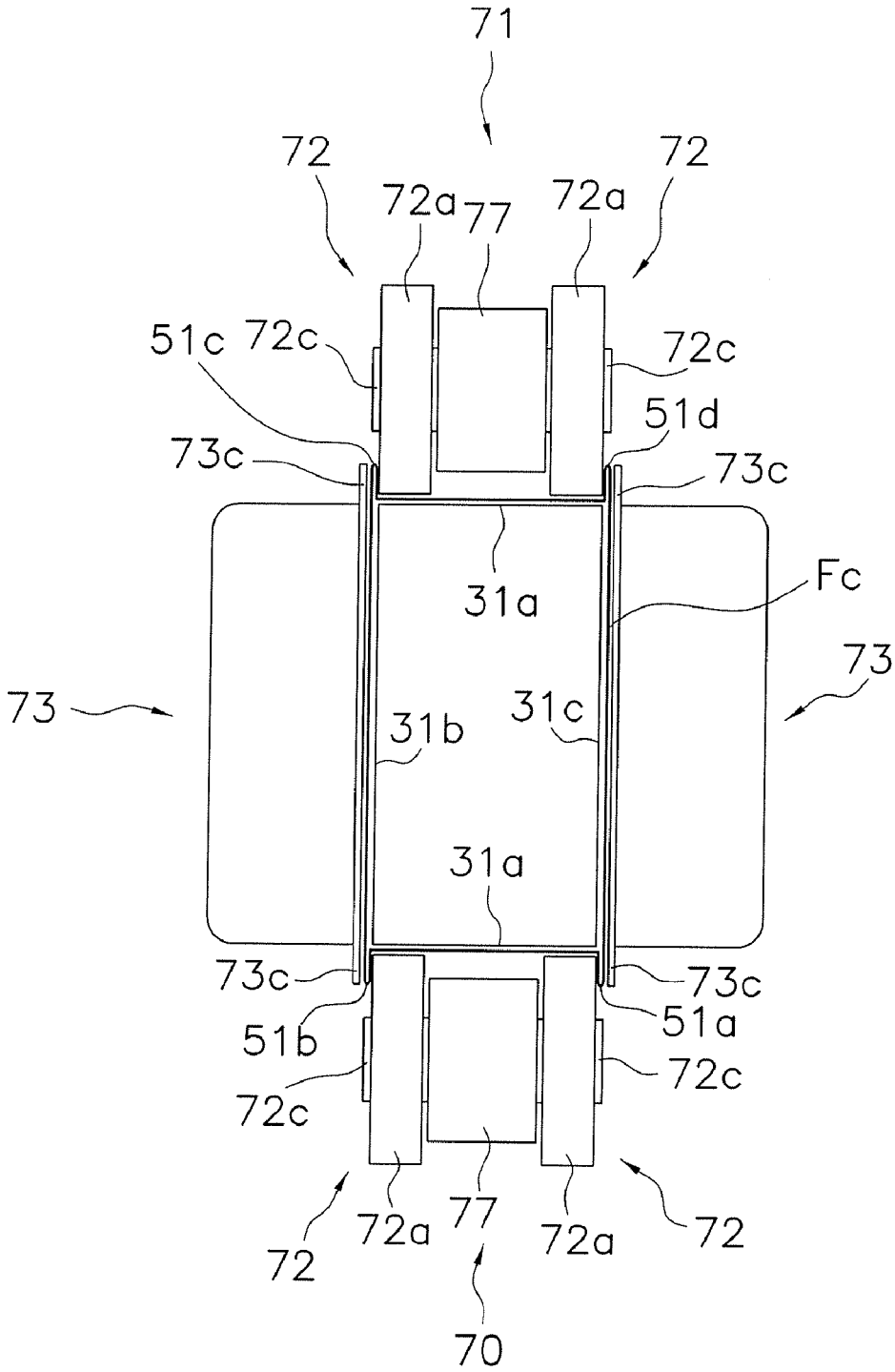
FIG. 10 is a cross-sectional view of the area around the hem-forming unit as taken along the section line X-X in FIG. 9.

As shown in FIGS. 8, 9 and 10, the hem-forming unit 70 primarily includes a pair of rollers 72, 72 and a pair of roller backing plates 73, 73. The hem-sealing unit 80 primarily includes a pair of heater blocks 82, 82 and a heater-block backing plate 83.

Both of the rollers 72, 72 are affixed via a linking member 77 to the base plate 33*a* of the supporting member 33 that supports the former 32. An aperture part is provided to the central portion of the base plate 33*a*, and the outline of this aperture part has a slightly larger shape than the external shape of the horizontal cross section of the tube 31. The tube 31 passes through this aperture part in the vertical direction. One of the two rollers 72, 72 is positioned near the left end of a lateral surface 31*a* of the tube 31, and the other roller 72 is positioned near the right end of the lateral surface 31*a* of the tube 31. Respective rotating shafts 72*c*, 72*c* of the rollers 72, 72 extend perpendicular to the direction of conveyance of the polygonal tubular film Fc, i.e., perpendicular to the heightwise direction of the tube 31. Respective circumferential surfaces 72*a*, 72*a* of the rollers are positioned so as to face the lateral surface 31*a* of the tube 31. The rollers 72, 72 are both positioned at the same height.

Both of the roller backing plates 73, 73 are metal plate members that are bent into an L shape, and both of the roller backing plates 73, 73 have a first surface 73*a* and a second surface 73*b* that are perpendicular to each other. The first surfaces 73*a*, 73*a*, respectively face the two lateral surfaces 31*b*, 31*c* that adjoin the lateral surface 31*a* of the tube 31, and both of the second surfaces 73*b*, 73*b* face the base plate 33*a* of the supporting member 33 that supports the former 32. Both of the roller backing plates 73, 73 are affixed to the base plate 33*a* via screws or other fixing members that are not shown. Both of the roller backing plates 73, 73 have substantially the same width in the horizontal direction as the tube 31, but the first surfaces 73*a*, 73*a* have edge parts 73*c*, 73*c* near the lateral ends. The edge parts 73*c*, 73*c* face respective external lateral surfaces 72*b*, 72*b* of the rollers 72, 72.

The circumferential surfaces 72*a*, 72*a* of the rollers 72, 72 and the lateral surface 31*a* of the tube 31 face each other across a gap of approximately the same thickness as the film Fc. The external lateral surfaces 72*b*, 72*b* of the rollers 72, 72 and the first surfaces 73*a*, 73*a* (or, more specifically, the first surfaces 73*a*, 73*a* of the edge parts 73*c*, 73*c*) of the roller backing plates 73, 73 face each other across a gap approximately twice the thickness of the film Fc. The first surfaces 73*a*, 73*a* of the roller backing plates 73, 73 and the lateral surfaces 31*b*, 31*c* of the tube 31 face each other across a gap approximately the same thickness as the film Fc. The polygonal tubular film Fc therefore passes through these gaps and is conveyed further downstream when the form-fill-seal machine 1 is driven (see FIG. 10). The circumferential surfaces 72*a* and the lateral surfaces 72*b* of the rollers 72, the first surfaces 73*a* of the roller backing plates 73, and the lateral surfaces 31*a* through 31*c* of the tube 31 are in a state of contact with the polygonal tubular film Fc during conveyance. Creases are thereby made at the four corners of the polygonal tubular film Fc, the hem parts 51*a*, 51*b* are formed, and the rollers 72 are pulled by the polygonal tubular film Fc and rotate about the rotating shafts 72*c*. The rotation of the rollers 72 reduces friction between the film F and the rollers 72, allowing the film F to be conveyed straight and smoothly.

Rollers in which the difference between the radius of the roller and the radius of the rotating shaft 72*c* of the roller is longer than the width of the hem parts 51*a* through 51*d* are used as the rollers 72. The width of the hem parts 51*a* through 51*d* here refers to the width of the hem parts 51*a* through 51*d* protruding from the lateral-surface parts 54. The hem parts 51*a* through 51*d* of the conveyed polygonal tubular film Fc (or, more accurately, the portions that will become the hem parts 51*a* through 51*d* of the polygonal tubular film Fc) will thereby contact only the portions of the lateral surfaces 72*b* of the rollers 72 that are rotating in the direction of conveyance and will not contact the rotating shafts 72*c* protruding from the lateral surfaces 72*b* of the rollers 72. The frictional force applied to the polygonal tubular film Fc is therefore reduced, and the film F can be prevented from meandering or warping.

The heater blocks 82, 82 are positioned below the rollers 72, 72 and the roller backing plates 73, 73. Both of the heater blocks 82, 82 have internal heaters. These heaters heat the sealing surfaces of the respective heater blocks 82, 82.

The heater-block backing plate 83 is positioned directly below the rollers 72, 72 and directly above the pull-down belt 40 and is positioned so as to face the lateral surface 31*a* of the tube 31. The heater-block backing plate 83 is affixed to the base plate 33*a* via a linking member that is not shown. The heater-block backing plate 83 is a generally rectangular parallelepiped plate member with two side surfaces of the heater-block backing plate 83 extending in the height direction being disposed so as to face the respective sealing surfaces of the heater blocks 82, 82. When the form-fill-seal machine 1 is driven, the heater blocks 82, 82 move with prescribed timing, and thereby the sealing surfaces of the heater blocks 82, 82 are pressed against the heater-block backing plate 83, with the hem parts 51*a*, 51*b* of the polygonal tubular film Fc sandwiched between the sealing surfaces and the heater-block backing plate 83. The hem parts 51*a*, 51*b* of the polygonal tubular film Fc are thereby heat sealed.

The roller backing plates 73, 73 contained in the hem-forming unit 70 are members that are also contained in the hem-forming unit 71 and are shared between both of the hem-forming units 70, 71.

c) Conveying Mechanism

The conveying mechanism 14 has the pair of pull-down belts 40, 41. The pull-down belts 40, 41 are supported by a supporting member (not shown) suspended from the top plate 29 of the supporting frame 12. The pull-down belts 40, 41 are positioned so as to extend in the vertical direction with lateral symmetry relative to the tube 31 that extends in the vertical direction. The pull-down belts 40, 41 serve to contact the polygonal tubular film Fc wrapped around the tube 31 and to chuck and convey the polygonal tubular film Fc downward.

The pull-down belt 40 has a driving roller 40*a*, a driven roller 40*b*, and a belt member 40*c* that has a chucking function. The pull-down belt 41 has a driving roller 41*a*, a driven roller 41*b*, and a belt member 41*c* that has a chucking function. The belt member 40*c* is wound around the driving roller 40*a* and the driven roller 40*b*, and the belt member 41*c* is wound around the driving roller 41*a* and the driven roller 41*b*. The pull-down belts 40, 41 are positioned so that the respective driving rollers 40*a*, 41*a* are higher than the driven rollers 40*b*, 41*b*.

A drive shaft 40*d* of the driving roller 40*a* of the pull-down belt 40 is rotatably driven by a motor 43 (see FIG. 6). When the driving roller 40*a* rotates according to the rotation of the drive shaft 40*d*, the belt member 40*c* wound around the driving roller 40*a* revolves between the driving roller 40*a* and the driven roller 40*b*.

A timing belt 44 (see FIG. 5) is wound around the drive shaft 40*d* of the driving roller 40*a* of the pull-down belt 40 and the drive shaft 41*d* of the driving roller 41*a* of the pull-down belt 41. The drive force transmitted to the drive shaft 40*d* from the motor 43 is therefore also transmitted to the drive shaft 41*d* via the timing belt 44, and the drive shaft 41*d* rotates together with the drive shaft 40*d*. In other words, the pull-down belt 41 also executes a revolving motion according to the revolving motion of the pull-down belt 40. The revolving motions of the pull-down belts 40, 41 are regulated so as to be executed at identical speeds. Substantially equal conveying forces are therefore applied from both the left and right sides relative to the direction of conveyance on the polygonal tubular film Fc that is conveyed along the tube 31. The film F does not warp or break during the course of conveyance and is processed into pouches 50 while the polygonal tube shape is properly maintained.

d) Vertical Sealing Mechanism

The vertical sealing mechanism 15 is supported by a supporting member (not shown) suspended from the top plate 29 of the supporting frame 12 and is positioned so as to extend in the vertical direction along the tube 31. The vertical sealing mechanism 15 occupies the same position in the height-wise direction as the four heater blocks 82 of the hem-sealing units 80, 81 (see FIG. 5). The vertical sealing mechanism 15 heats and seals the vertically extending overlapping portions of the polygonal tubular film Fc, which is wrapped around the tube 31, while pressing these portions against the lateral surface 31*b* of the tube 31 at a constant pressure, thereby forming the vertical seal part 52. The vertical sealing mechanism 15 has a heater, a heater belt heated by the heater, and the like. The vertical sealing mechanism 15 faces the lateral surface 31*b* of the tube 31 and extends in the vertical direction in the vicinity of the center of the lateral surface 31*b*.

e) Horizontal Sealing Mechanism

The horizontal sealing mechanism 17 is positioned below the tube 31 and is supported by the supporting frame 12, as shown in FIG. 6. The horizontal sealing mechanism 17 has a pair of left and right rotating shafts 17*a*, 17*a*, a pair of left and right sealing jaws 17*b*, 17*b*, and a pair of left and right arm members 17*c*, 17*c*.

The sealing jaws 17*b*, 17*b* have internal heaters. The sealing surfaces of the sealing jaws 17*b*, 17*b* (the surfaces that face each other during horizontal sealing) are heated by these heaters. The polygonal tubular film Fc that is sandwiched by the sealing jaws 17*b*, 17*b* is heat sealed by these heaters, and the horizontal seal parts 53 are formed. The sealing jaws 17*b*, 17*b* are linked to the rotating shafts 17*a*, 17*a* via the arm members 17*c*, 17*c* and swivel around the rotating shafts 17*a*, 17*a*. The rotating shafts 17*a*, 17*a* cause the sealing jaws 17*b*, 17*b* to revolve. The rotating shafts 17*a*, 17*a* also move horizontally so as to be close to and away from each other, causing the polygonal tubular film Fc to be sandwiched by the sealing jaws 17*b*, 17*b* with appropriate timing.

(3) Hem-Sealing Operation of Form-Fill-Seal Machine

When the conveying mechanism 14 is driven, the film F is unwound from the film roll of the film-feeding unit 6 and guided to the forming mechanism 13. In the forming mechanism 13, the sheet-form film F that was unwound from the film roll proceeds along the surface of the former 32. The film F is wrapped around the external surface of the polygonal tube 31 when passing through the gap between the former 32 and the tube 31 and is made into the polygonal tubular film Fc. The polygonal tubular film Fc is then also conveyed downwards with the internal surface of the film being along the external surface of the tube 31. The hem parts 51*a* through 51*d* are formed at the four corners of the film when the film passes through the hem-forming units 70, 71.

To be more specific, in the hem-forming units 70, 71, the portions of the polygonal tubular film Fc that will become the hem parts 51*a* through 51*d* are sandwiched between the four lateral surfaces 72*b* of the four rollers 72 and the four edge parts 73*c* of the two roller backing plates 73, and the portions neighboring the portions that will become the hem parts 51*a* through 51*d* of the polygonal tubular film Fc are sandwiched between the two lateral surfaces 31*a* of the tube 31 and the four circumferential surfaces 72*a* of the four rollers 72. The portions that will become the lateral-surface parts 54 of the polygonal tubular film Fc are sandwiched between the two lateral surfaces 31*b*, 31*c* of the tube 31 and the first surfaces 73*a* of the roller backing plates 73. The polygonal tubular film Fc is then conveyed downward by the conveying mechanism 14 in this state, in which the prescribed portions are sandwiched in the prescribed gaps, whereby creases are formed in the polygonal tubular film Fc, and the four hem parts 51*a* through 51*d* are formed. The hem parts 51*a* through 51*d* that were formed in the hem-forming units 70, 71 are then heat sealed in the hem-sealing units 80, 81. After passing the four rollers 72, the polygonal tubular film Fc is conveyed further downstream, sandwiched between the two heater-block backing plates 83 and the two lateral surfaces 31*a* of the tube 31.

The vertical sealing mechanism 15, which is at substantially the same height as the hem-sealing units 80, 81, heat seals the portion that will become the vertical seal part 52 of the polygonal tubular film Fc at substantially the same time that the hem-sealing units 80, 81 heat seal the hem parts 51*a* through 51*d* of the polygonal tubular film Fc.

The polygonal tubular film Fc then passes from the tube 31 and falls to the horizontal sealing mechanism 17. In the horizontal sealing mechanism 17, the portion of the polygonal tubular film Fc that will become the lower end part of the pouch 50 is heat sealed in the horizontal direction. A clump of product falls from the computer scale 2 through the inside of the tube 31 at this time and is collected within the polygonal tubular film Fc. The portion of the polygonal tubular film Fc that will become the upper end part of the pouch 50 is heat sealed in the horizontal direction with the product filled inside of the film. A cutter (not shown) housed within one of the sealing jaws 17*b*, 17*b* then cuts the heat-sealed portion in the horizontal direction. The preceding pouch is thereby cut from the pouch following.

Form-Fill-Seal Machine in Pillow-Type Pouches Manufacturing State

The form-fill-seal machine 1 will next be described in a state set so as to be capable of manufacturing the pillow-type pouch 60. The change of the form-fill-seal machine 1 from a state capable of manufacturing the hem-seal-type pouch 50 to a state capable of manufacturing the pillow-type pouch 60 will be described, and the description will focus on the differences between the two states.

In the form-fill-seal machine 1, the film-feeding unit 6 can be used both when manufacturing the hem-seal-type pouch 50 and when manufacturing the pillow-type pouch 60. Therefore, primarily the components included in the form-fill-seal unit 5 are changed during the operation for modifying the form-fill-seal machine 1. However, the film roll set in the film-feeding unit 6 must be changed appropriately according to the pouch to be manufactured.

When manufacturing the pillow-type pouch 60, the aforedescribed polygonal tube 31 is exchanged for a circular tube 131, and the aforedescribed former 32 is exchanged for a former 132, which is capable forming a sheet-form film into a circular tube shape. The supporting member 33 is also exchanged at this time for a supporting member 133 corresponding to the shapes of the tube 131 and the former 132. The tube 31 and the former 32 are affixed to the supporting member 33, and the tube 131 and the former 132 are affixed to the supporting member 133. The supporting members 33, 133, are therefore removed and assembled as integral members with the respective tubes 31, 131 and the formers 32, 132. The rollers 72, the roller backing plates 73, the heater blocks 82, and the heater-block backing plate 83 affixed to the base plate 33*a* of the supporting member 33 will also be removed when the supporting member 33 is removed, but, unlike the manufacture of the hem-seal-type pouch 50, the manufacture of the pillow-type pouch 60 does not require the hem parts 51*a* through 51*d* to be formed in the pouches. Therefore, these components 72, 73, 82, 83 need not be reattached to the base plate 133*a* of the supporting member 133 after changing. The widths of the tube 31 and the tube 131 are different, and therefore the pull-down belts 40, 41 must both be slid to the inside or the outside along a lateral sliding mechanism (not shown) according to the width of the new tube 131 after changing out the tube 31. In other words, this lateral sliding mechanism serves to accommodate the difference in the width of the tubes before and after exchange.

Figure 11:
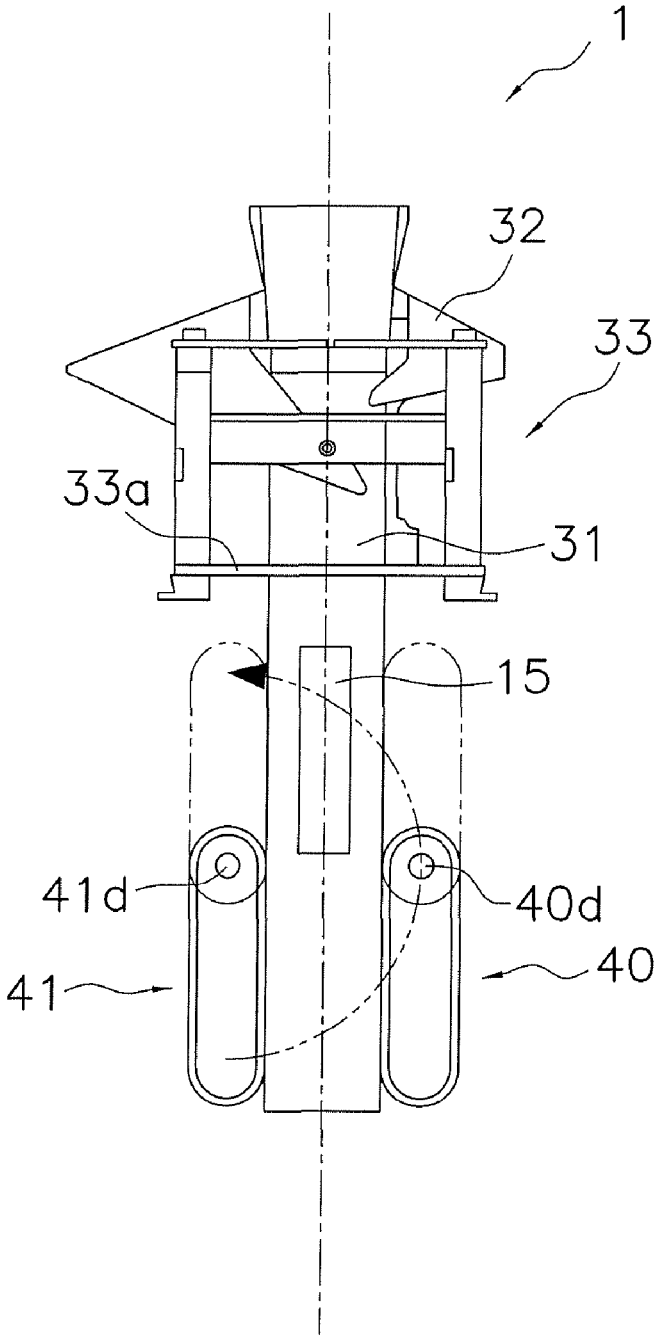
FIG. 11 is a schematic view of showing the swiveling operation of the pull-down belt.

When the hem-forming mechanism 18 is removed, the space below the former 32 and directly above the pull-down belts 40, 41 is opened. Accordingly, the pull-down belts 40, 41 are swiveled 180° inward about the respective drive shafts 40*d*, 41*d*, as shown in FIG. 11. The pull-down belts 40, 41 thereby move upward by an amount substantially equivalent to the length of the pull-down belts 40, 41 in the longitudinal axial direction. This swiveling operation must be performed after removing the tube 31, which was in place before the change, and before attaching the tube 131, which is in place after the change. When the new width between the pull-down belts 40, 41 is narrow, and the pull-down belts 40, 41 cannot be swiveled inward, the pull-down belts 40, 41 can be slid outward using the aforedescribed lateral sliding mechanism, and the space for rotation can be ensured.

A pair of left and right shaker members 90 is then attached in the space opened by moving the pull-down belts 40, 41 upward. The shaker members 90 sandwich a prescribed position on the film formed into a circular tube shape by the tube 131 and the former 132 (hereinafter, the circular tubular film Fd) with a prescribed timing and shake the film Fd. During the execution of the shaking operation of the shaker members 90, only the portion of the circular tubular film Fd that will become the lower end of the pouch 60 is horizontally sealed, and products falling from the computer scale 2 are filled into the interior. The products are collected inside at the bottom of the circular tubular film Fd by this shaking operation. The products that fall from the computer scale 2 and are filled into the pillow-type pouch 60 are generally more voluminous as compared to the hem-seal-type pouch 50. Such shaker members 90 are therefore preferably attached when manufacturing the pillow-type pouch 60, because there is less chance that products will be caught up when horizontally sealing the portion that will become the upper end of the pouch after the products have been filled in.

When modifying the form-fill-seal machine 1 from a state capable of manufacturing the pillow-type pouch 60 to a state capable of manufacturing the hem-seal-type pouch 50, the modification operation may be performed in the reverse of the order described above.

Characteristics (1) The pull-down belts 40, 41 are designed so as to be able to be swiveled 180° about the respective drive shafts 40*d*, 41*d*. The pull-down belts 40, 41 are thereby positioned downstream when manufacturing the hem-seal-type pouch 50, and the pull-down belts 40, 41 can be swiveled 180° and moved upstream when changing to the manufacture of the pillow-type pouch 60. The modification operation can thereby be performed in a short period of time in the form-fill-seal machine 1.

(2) The motor 43 is linked to the drive shaft 40*d* of the pull-down belt 40 in the form-fill-seal machine 1, and the timing belt 44 is wound between the drive shaft 40*d* of the pull-down belt 40 and the drive shaft 40*d* of the pull-down belt 41.

On the other hand, the drive shafts 40*d*, 41*d* of the pull-down belts 40, 41 in the form-fill-seal machine 1 do not move in the height-wise direction even when the pull-down belts 40, 41 are swiveled. The various components 43, 44 that are linked to the drive shafts 40*d*, 41*d* of the pull-down belts 40, 41 therefore do not need to be moved in the height-wise direction even when the pull-down belts 40, 41 are swiveled. The modification operation can therefore be performed in a short period of time in the form-fill-seal machine 1.

Modified Examples (A) In the aforedescribed embodiment, the pull-down belts 40, 41 are capable of swiveling 180° about the respective drive shafts 40*d*, 41*d*. However, the movement aspect of the pull-down belts 40, 41 according to the present invention is not limited to swiveling movement about the drive shafts 40*d*, 41*d*. For example, components other than the drive shafts 40*d*, 41*d* may be set as the center of rotation, or an appropriate vertical sliding mechanism may be provided, whereby the pull-down belts 40, 41 slide in the vertical direction.

(B) The pull-down belts 40, 41 may also be designed to swivel outward instead of inward about the respective drive shafts 40*d*, 41*d*. Alternatively, the pull-down belts 40, 41 may be designed to rotate both inward and outward.

Figure 12:
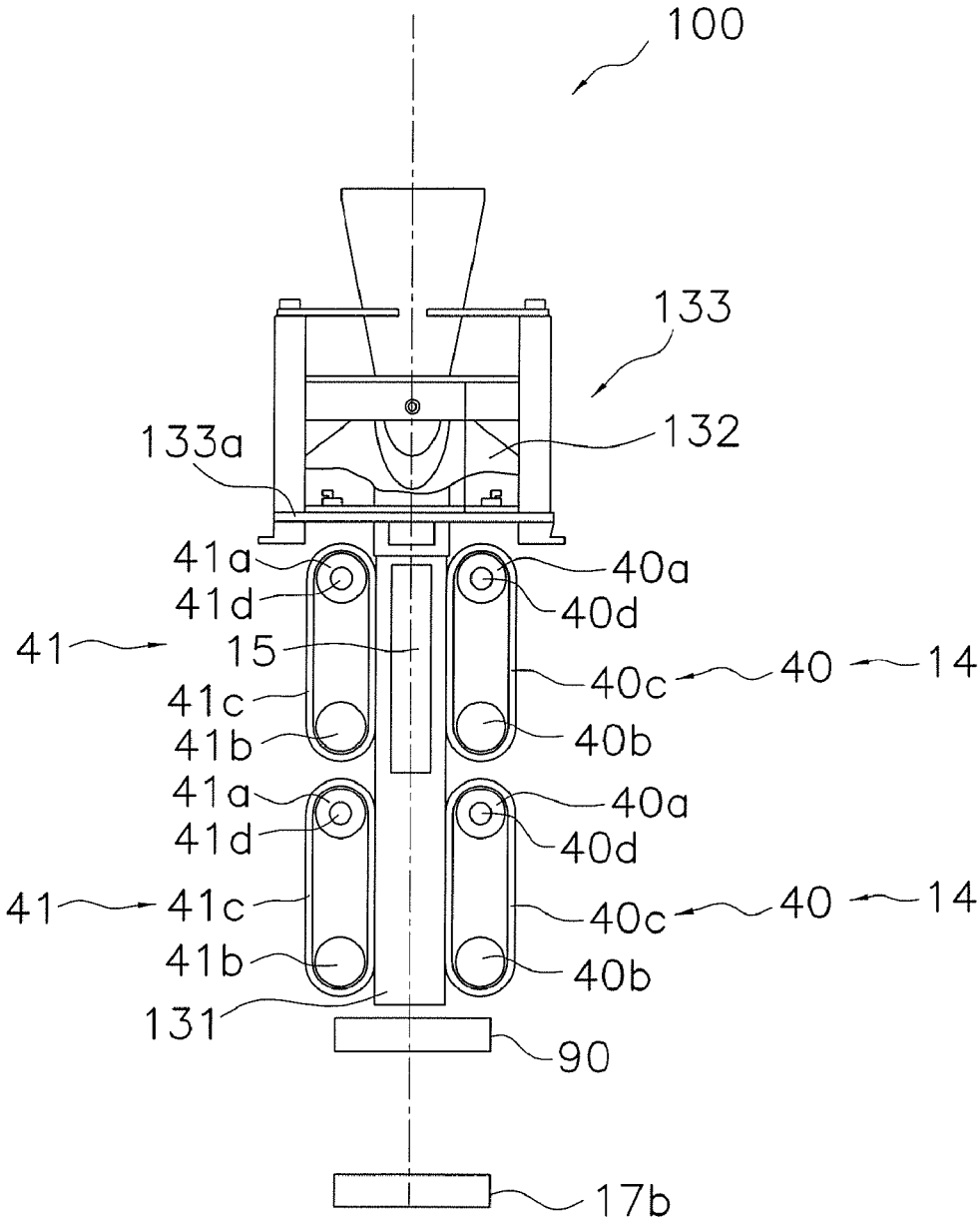
FIG. 12 is a front view that shows the main portions of a form-fill-seal machine in a state capable of manufacturing the pillow-type pouch according to a modified example.

(C) The pull-down belts 40, 41 in the aforedescribed form-fill-seal machine 1 were attached to the left and right at a single level, but, as in a form-fill-seal machine 100 shown in FIG. 12, the pull-down belts 40, 41 may also be attached to the left and the right at two (or three or more) levels. The form-fill-seal machine 100 of FIG. 12 is in a state capable of manufacturing the pillow-type pouch 60.

Figure 13:
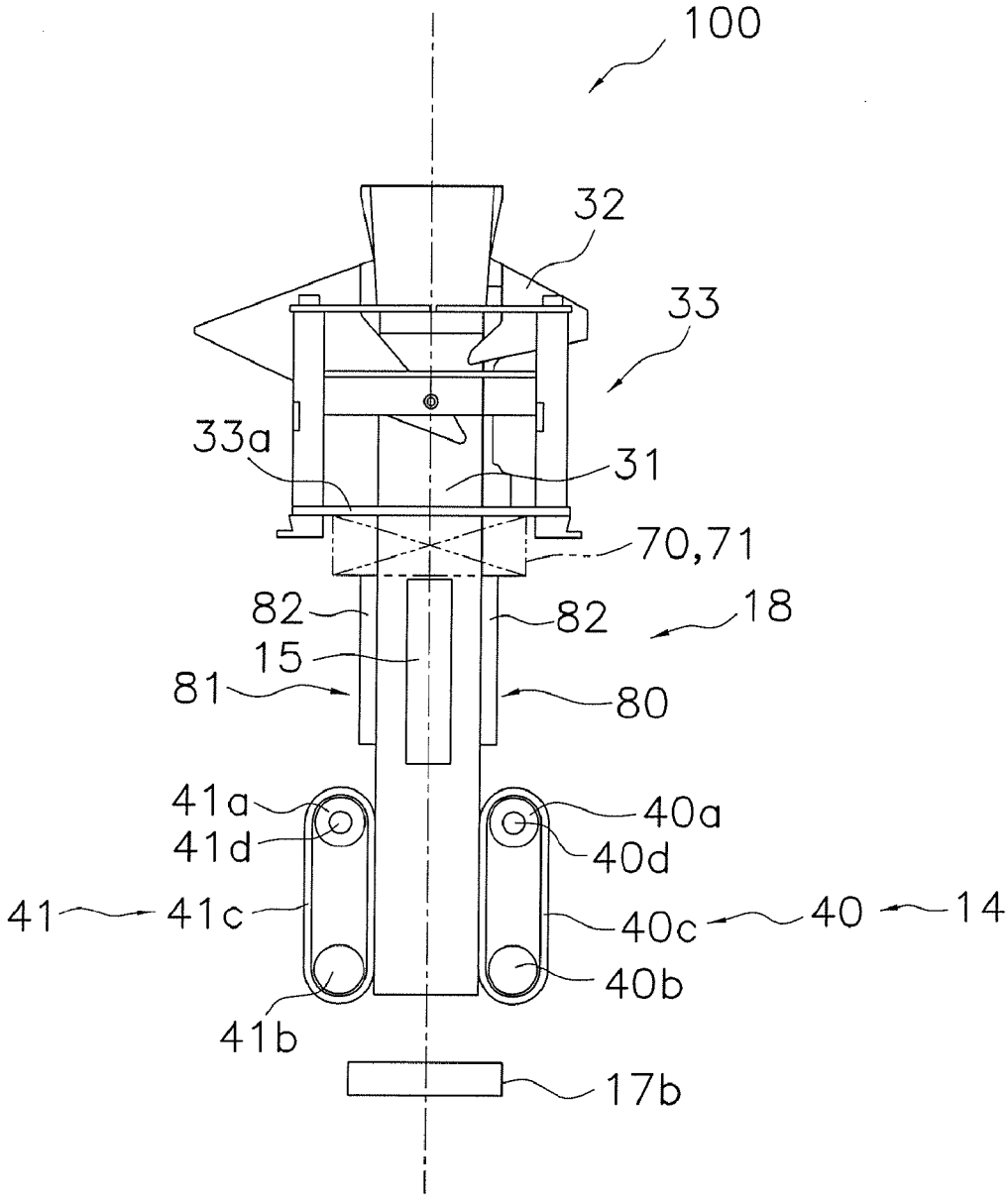
FIG. 13 is a front view that shows the main portions of the form-fill-seal machine in a state capable of manufacturing the hem-seal-type pouch according to the modified example.

The form-fill-seal machine 100 of FIG. 12 can be modified to a state capable of manufacturing the hem-seal-type pouch 50 (see FIG. 13) by removing the upper-level pull-down belts 40, 41 and attaching the hem-forming mechanism 18 in the space opened thereby. The shaker members 90, which are no longer necessary, are preferably removed at this time, and the horizontal sealing mechanism 17 is preferably displaced upward.

The pull-down belts 40, 41 at one level are thus removed, and a new component is attached in the space opened, whereby the form-fill-seal machine 100 provided with the pull-down belts 40, 41 at a plurality of upper and lower levels may be used as a flexible packaging machine that is capable of manufacturing pouches of a plurality of types.

The present invention is useful as a form-fill-seal machine, and is particularly useful as a form-fill-seal machine for manufacturing pouches of a plurality of types having different shapes (a flexible packaging machine). The present invention allows the modification operation for changing this form-fill-seal machine from a state capable of manufacturing one type of pouch to a state capable of manufacturing another type of pouch to be readily performed.

The invention claimed is:

1. A form-fill-seal machine for manufacturing pouches of a plurality of types having different shapes, the form-fill-seal machine comprising:

a tubular part that is replaceable according to a shape of the pouch to be manufactured;

a conveying part configured and arranged to convey tubular packaging material along the tubular part with an internal surface of the packaging material facing an external surface of the tubular part, a position of the conveying part with respect to the tubular part being selectively movable according to the shape of the pouch to be manufactured, the position of the conveying part with respect to the tubular part being selectively movable between a first position and a second position that is further downstream than the first position in a direction of conveyance of the packaging material; and a sealing part configured and arranged to seal a prescribed position on the packaging material conveyed by the conveying part.

2. The form-fill-seal machine according to claim 1, wherein the conveying part is configured and arranged to slide between the first position and the second position to change the position of the conveying part with respect to the tubular part.

3. The form-fill-seal machine according to claim 1, wherein the conveying part is configured and arranged to swivel between the first position and the second position to change the position of the conveying part with respect to the tubular part.

4. The form-fill-seal machine according to claim 1, wherein the conveying part has a rotatably driven drive shaft and a belt member wound around the drive shaft to form a conveying surface for contacting the packaging material.

5. The form-fill-seal machine according to claim 4, further comprising a driving part configured and arranged to rotatably drive the drive shaft, the conveying part being configured and arranged to swivel about the drive shaft between the first position and the second position.

6. The form-fill-seal machine according to claim 1, wherein the conveying part has a first conveying unit and a second conveying unit that is positioned symmetrically with respect to the first conveying unit about the tubular part that extends in the direction of conveyance, the first conveying unit has a rotatably driven first drive shaft and a first belt member wound around the first drive shaft to form a first conveying surface for contacting the packaging material, and the second conveying unit has a rotatably driven second drive shaft and a second belt member wound around the second drive shaft to form a second conveying surface for contacting the packaging material.

7. The form-fill-seal machine according to claim 6, further comprising a driving part configured and arranged to rotatably drive the first drive shaft, and a drive-force transmitting part configured and arranged to transmit to the second drive shaft a drive force transmitted to the first drive shaft from the driving part, the first conveying unit being configured and arranged to swivel about the first drive shaft between the first position and the second position, and the second conveying unit being configured and arranged to swivel about the second drive shaft between the first position and the second position.

8. The form-fill-seal machine according to claim 1, further comprising a shaking part that, when the conveying part is in the first position, is positioned downstream of the conveying part in the direction of conveyance, and configured and arranged to sandwich and shake the packaging material.

9. The form-fill-seal machine according to claim 1, further comprising a hem-forming part that, when the conveying part is in the second position, is positioned upstream of the conveying part in the direction of conveyance, and configured and arranged to form a hem part in the packaging material.

10. The form-fill-seal machine according to claim 1, wherein the tubular part is replaceable between a structure with a hem-forming mechanism and a structure without a hem-forming mechanism.

* * * * *